US011387574B2

(12) United States Patent
Powell et al.

(10) Patent No.: US 11,387,574 B2
(45) Date of Patent: Jul. 12, 2022

(54) VERTICALLY AND HORIZONTALLY POLARIZED OMNIDIRECTIONAL ANTENNAS AND RELATED METHODS

(71) Applicant: Radio Frequency Systems, Inc., Meriden, CT (US)

(72) Inventors: Charles M. Powell, Vernon, CT (US); Warren F. Hunt, Farmington, CT (US)

(73) Assignee: Nokia Shanghai Bell Co., Ltd, Shanghai (CN)

( * ) Notice: Subject to any disclaimer, the term of this patent is extended or adjusted under 35 U.S.C. 154(b) by 420 days.

(21) Appl. No.: 14/066,477

(22) Filed: Oct. 29, 2013

(65) Prior Publication Data

US 2015/0116177 A1 Apr. 30, 2015

(51) Int. Cl.

| | |
|---|---|
| ***H01Q 21/24*** | (2006.01) |
| ***H01Q 21/08*** | (2006.01) |
| ***H01Q 1/24*** | (2006.01) |

(52) U.S. Cl.

CPC ..... *H01Q 21/24* (2013.01); *H01Q 21/08* (2013.01); *H01Q 1/246* (2013.01)

(58) Field of Classification Search

CPC ... H01Q 21/24; H01Q 21/08–12; H01Q 1/246
See application file for complete search history.

(56) References Cited

U.S. PATENT DOCUMENTS

| | | | | |
|---|---|---|---|---|
| 7,663,544 | B2 * | 2/2010 | Thomas | H01Q 1/246 342/361 |
| 2009/0096699 | A1 | 4/2009 | Chiu et al. | |
| 2010/0227646 | A1 * | 9/2010 | Ogawa | H01Q 1/246 455/562.1 |
| 2010/0227647 | A1 * | 9/2010 | Shimizu | H01Q 1/246 455/562.1 |

FOREIGN PATENT DOCUMENTS

| | | | |
|---|---|---|---|
| WO | WO2003/007422 | 1/2003 | |
| WO | WO 03007422 A1 * | 1/2003 | H01Q 9/16 |
| WO | WO2006/136793 | 12/2006 | |
| WO | WO2008063111 | 5/2008 | |

OTHER PUBLICATIONS

Antenna Theory: A Review, Balanis, Proc. IEEE vol. 80 No 1 Jan. 1992.*

* cited by examiner

*Primary Examiner* — Andrea Lindgren Baltzell
*Assistant Examiner* — Amal Patel
(74) *Attorney, Agent, or Firm* — Capitol Patent & Trademark Law Firm, PLLC

(57) ABSTRACT

An omni-directional antenna module includes a plurality of vertically and horizontally polarized antenna elements arranged to provide 360° coverage around an antenna, and to eliminate nulls below the antenna. The antenna elements are arranged in parallel with respective orthogonal axes of a three-dimensional Cartesian coordinate system, with the centers of the antenna elements being arranged collinearly along the vertical or "Z" axis so that the radiation patterns of the individual orthogonally polarized dipoles do not interfere.

8 Claims, 3 Drawing Sheets

VERTICALLY AND HORIZONTALLY POLARIZED OMNIDIRECTIONAL ANTENNAS AND RELATED METHODS

INTRODUCTION

Base stations used in small cell, cellular mobile radio networks and applications may include antennas that cover a few streets or blocks. In such applications it is important to minimize the visual impact of the antenna, while still providing full 360° coverage with minimal nulls.

Current dual polarized omni antennas used in such base stations are usually quasi-omnis, which means that there are three ±45° polarized panel antennas in a single canister. Each panel covers a 120° sector, thus providing 360° coverage.

A problem with conventional ±45° polarized panel antennas used in small cell applications is that the −45° and +45° directions vary around the antenna, and orthogonality, is highly compromised at certain angles. In addition, both polarization patterns have deep nulls directly below the antenna. This is a significant disadvantage in small cell applications where many users may be expected to be directly below the antenna.

While ±45° polarized panel antennas are standard for dual polarized omni antenna applications, vertically and horizontally polarized antennas are currently also commercially available for applications other than small cell omni-directional base station applications. However, the current practice with these antennas is to mount the orthogonally polarized antenna elements on a single mounting bracket, with individual dipoles being mutually, transversely arranged but not collinear. Such an arrangement is not suitable for small cell omni-directional applications because the radiation patterns of the individual non-collinear dipoles affect each other and, therefore, the resulting antenna cannot provide uniform omni-directional coverage.

SUMMARY

Embodiments of the present invention are directed at solving the problems described above. In particular, embodiments of the invention include dual polarized, omni-directional antenna modules and related methods that are capable of receiving and/or transmitting electromagnetic waves made up of antenna elements having orthogonal first and second linear polarizations. The orthogonal first and second linear polarizations are in the vertical and horizontal directions with respect to the earth beneath the antenna module, and centers of the individual antenna elements are arranged collinearly to avoid interference between respective antenna patterns.

In one embodiment of the invention, an omni-directional antenna module may comprise a plurality of vertically and horizontally polarized antenna elements arranged to provide 360° coverage (around an antenna), and to eliminate nulls below the antenna. The antenna elements are arranged in parallel with respective orthogonal axes of a three-dimensional Cartesian coordinate system, with the centers of the antenna elements being vertically aligned, i.e., arranged collinearly along the vertical or "Z" axis of the three-dimensional Cartesian coordinate system, so that the radiation patterns of the individual orthogonally polarized dipoles do not interfere. centers of the antenna elements are arranged collinearly along a vertical axis.

According to another embodiment of the invention, a number of the vertically polarized antenna elements is at least three, and the three vertically polarized antenna elements are arranged to coaxially extend along the vertical axis, at least three horizontally polarized antenna elements extend in parallel with a first horizontal axis of a three-dimensional Cartesian coordinate system, and at least two horizontally polarized antenna elements extend in parallel to a second horizontal axis of the three-dimensional Cartesian coordinate system. Those skilled in the art will appreciate that the terms "X-axis" and "Y-axis" may be freely interchanged in this context with no substantive effect on the actual construction of the antenna.

Further, respective pairs consisting of one of the vertically polarized antenna elements and one of the horizontally polarized antenna elements may be arranged concentrically. The horizontally-polarized antenna elements of this embodiment may have a half-wavelength spacing, while the spacing of the vertically-polarized antenna elements may be approximately one-wavelength.

Exemplary antenna elements of an antenna module may be dipoles or slots, the structure of the individual antenna elements forming no part of the present invention so long as the antenna elements are horizontally and vertically polarized, and can be arranged to have collinear centers. In addition, exemplary omni-directional antennas may be mounted in a single radome of a small cell base station (e.g. at. least one vertically polarized antenna element, and one or more horizontally polarized antenna elements).

In addition to the antenna modules describe above, the present invention also provides for related methods for configuring an omni-directional antenna. One such method may comprise: arranging a plurality of vertically polarized antenna elements and a plurality of horizontally polarized antenna elements to provide 360° coverage, and to eliminate nulls below an antenna; arranging the vertically polarized antenna elements and the horizontally polarized antenna element are in parallel with respective orthogonal axes of a three-dimensional Cartesian coordinate system; and arranging centers of the antenna elements collinearly along a vertical axis of the three-dimensional Cartesian coordinate system.

In one exemplary method a number of the vertically polarized antenna elements is at least three, and the method further comprises coaxially extending the three vertically polarized antenna elements along the vertical axis, and extending at least three horizontally polarized antenna elements in parallel with a first horizontal axis of the three-dimensional Cartesian coordinate system, and extending at least two horizontally polarized antenna elements in parallel to a second horizontal axis of the three-dimensional Cartesian coordinate system.

In additional embodiments, the method may further comprise: (i) concentrically arranging respective pairs consisting of one of the vertically polarized antenna elements and one of the horizontally polarized antenna elements; (ii) concentrically arranging respective pairs consisting of one of the vertically polarized antenna elements and one of the horizontally polarized antenna elements; and/or (iii) mounting the omni-directional antenna module in a single radome of a small cell base station.

Yet further, in the methods described above and herein the horizontally polarized antenna elements may have a half-wavelength spacing, while a spacing of the vertically polarized antenna elements may be approximately one-wavelength.

DETAILED DESCRIPTION, INCLUDING EXAMPLES

Throughout the following description and drawings, like reference numbers/characters refer to like elements. It should be understood that, although specific exemplary embodiments are discussed herein there is no intent to limit the scope of present invention to such embodiments. To the contrary, it should be understood that the exemplary embodiments discussed herein are for illustrative purposes, and that modified and alternative embodiments may be implemented without departing from the scope of the present invention.

Figure 1:
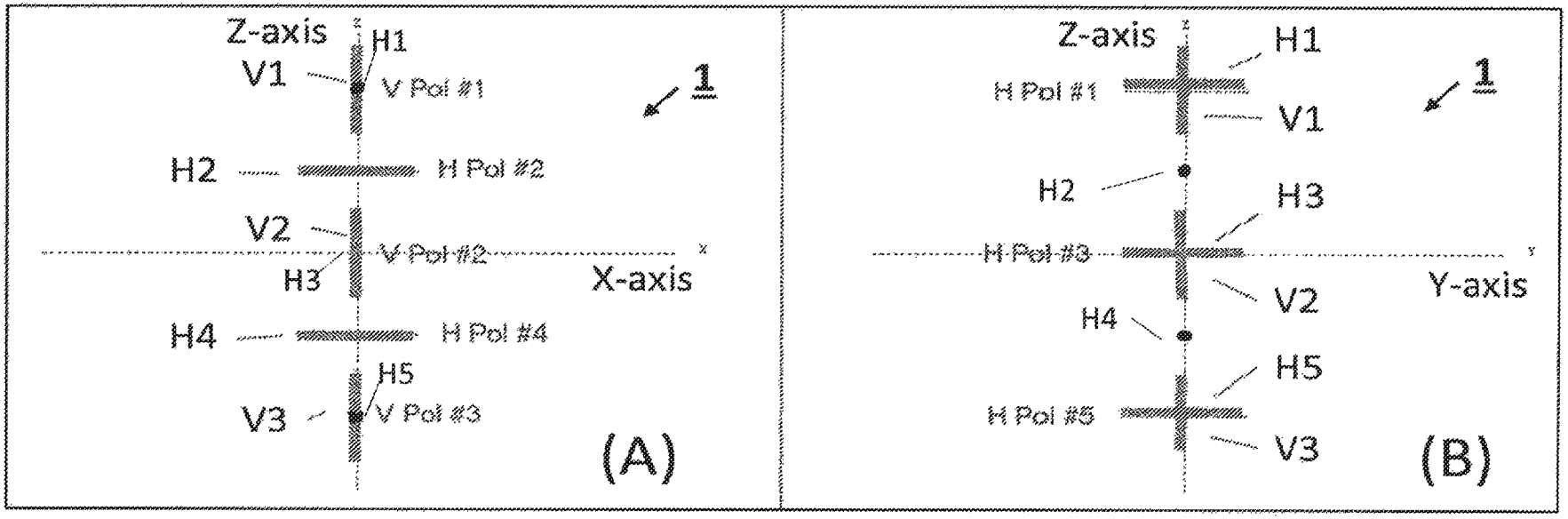
FIG. 1(A) is a schematic side view of an omni-directional antenna module constructed in accordance with an embodiment of the invention, viewed in the X-Z plane.
FIG. 1(B) is a schematic side view of the antenna module of FIG. 1(A), viewed in the Y-Z plane.
Figure 2:
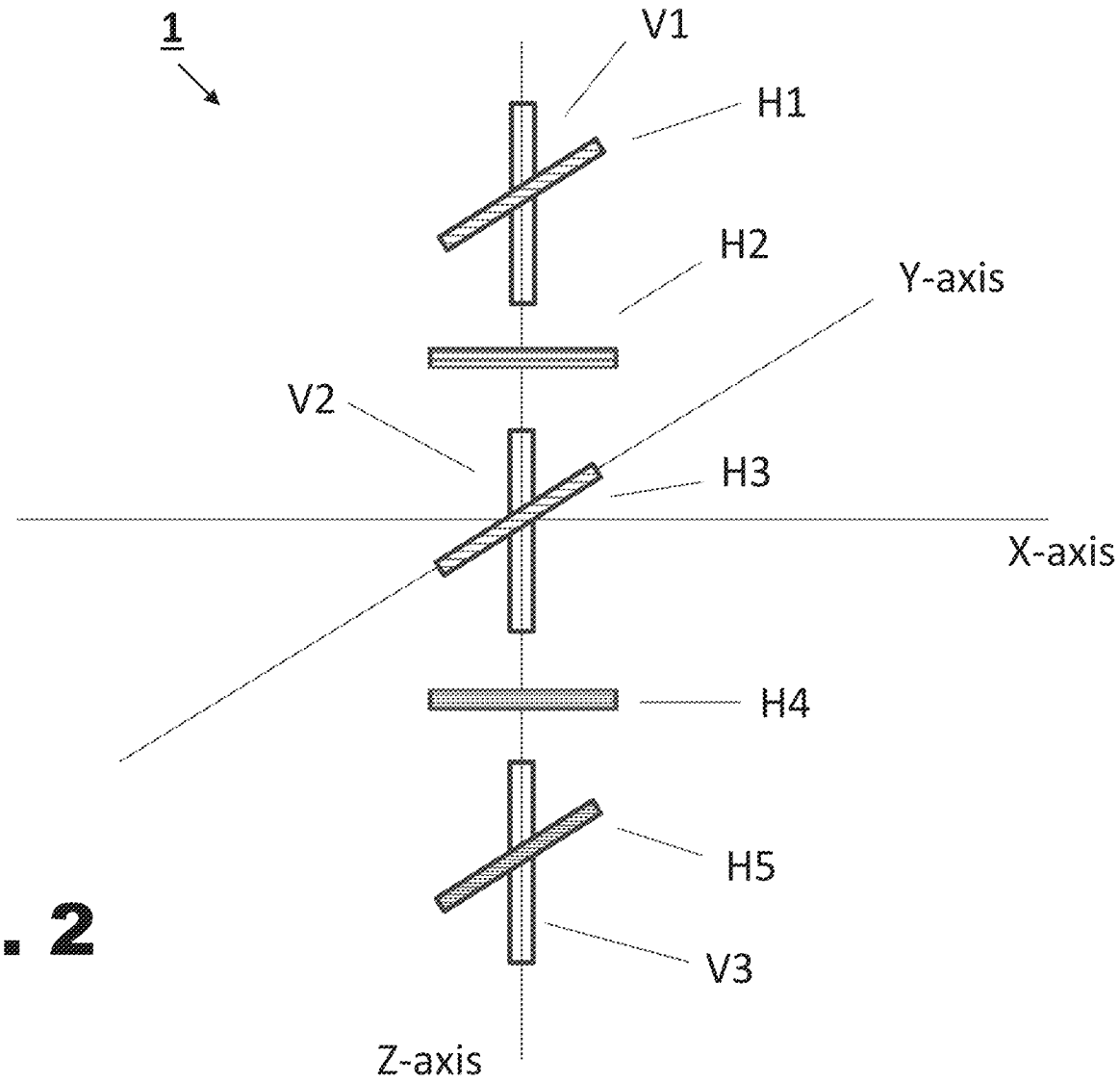
FIG. 2 is an isometric schematic view of the omni-directional antenna module illustrated in FIGS. 1(A) and 1(B).

Referring to FIGS. 1(A), 1(B), and 2, there is depicted an omni-directional antenna module 1 that comprises a plurality of vertically and horizontally polarized antenna elements arranged in parallel with respective orthogonal axes of a three-dimensional Cartesian coordinate system. The centers of the individual antenna elements are arranged collinearly along the vertical or "Z" axis so that the radiation patterns of the individual orthogonally polarized dipoles are mutually independent and do not interfere.

More specifically, as illustrated in each of FIGS. 1(A), 1(B), and 2, the omni-directional antenna module 1 may comprise three vertically-polarized antenna elements V1, V2, and V3 coaxially arranged along the Z-axis of the coordinate system. The Z-axis extends in the vertical direction with respect to the earth, and the X and Y axes extend in mutually orthogonal horizontal directions with respect to the earth, although the specific directions of the X and Y axes is arbitrary so long as the axes are in a horizontal plane. As depicted in FIGS. 1(A) and 2, two horizontally polarized antenna elements H2 and H4 may be situated midway between adjacent ones of the vertically polarized antenna element V1, V2, and V3, and extend in parallel with the X-axis. The centers of the horizontally polarized antenna elements H2 and H4 are collinear with the vertically polarized antenna elements V1, V2, and V3. As depicted in FIGS. 1(B) and 2, three additional horizontally polarized antenna elements H1, H3, and H5 may be arranged concentrically with the three vertically polarized antenna elements to extend in parallel with the Y-axis.

The vertical spacing of the horizontal antenna elements H1-H5 may be one-half wavelength while the spacing of the vertically polarized antenna elements V1, V2, and V3 in the illustrated embodiment may be one-wavelength.

It will be appreciated that the antenna elements V1-V3 and H1-H5 are depicted schematically, and that the dimensions and structure of the individual elements are not intended to be limiting and may be varied without departing from the scope of the invention. For example, the antenna elements may take the form of either dipoles or slots. In addition, the number of vertical and/or horizontal antenna elements may be varied, and it is not essential that any of the horizontal antenna elements be situated midway between, or concentric with respect to, the vertical antenna elements, so long as the centers of all of the antenna elements are collinear.

Figure 3:
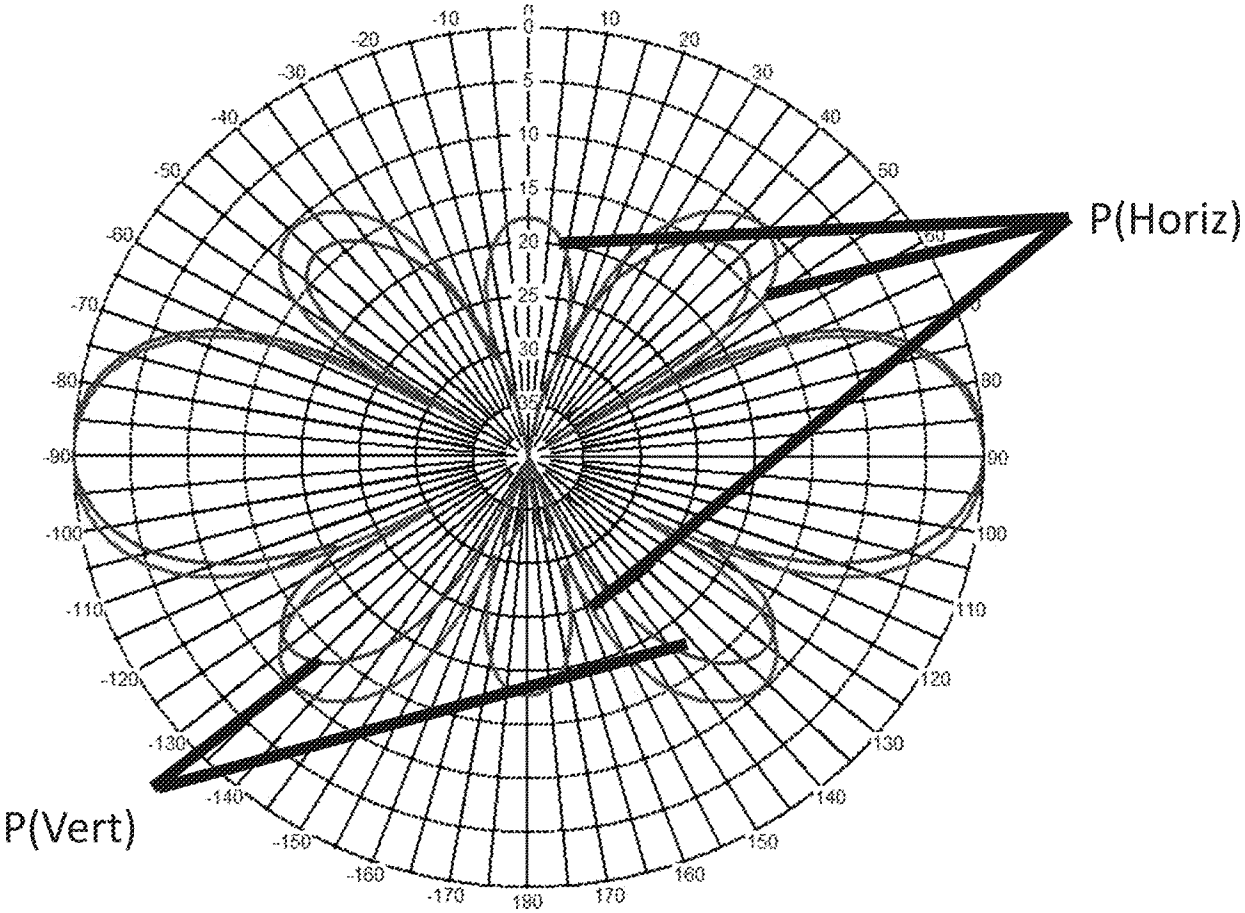
FIG. 3 shows the horizontal and vertical polarization patterns of an antenna module in accordance with an embodiment of the invention.

The antenna illustrated in FIGS. 1(A), 1(B), and 2 are especially suitable for small cell base stations applications, in which the antenna module 1 (and antenna) may be mounted in a single radome. This suitability is apparent from the vertical polarization pattern P(Vert) and horizontal polarization pattern P(Horiz) illustrated in FIG. 3, which show that the horizontal polarization pattern P(Horiz) extends vertically downward and, therefore, eliminates the problem of nulls below the base station.

As is known to those skilled in the art, the polarization patterns may be adjusted as required by phasing and amplitude adjustment structures or techniques, which are not part of the present invention, the scope of which is defined by the appended claims.

What is claimed is:

1. An omnidirectional antenna module consisting of:

a set of three vertically polarized antenna elements disposed in a collinear arrangement along a vertical Z-axis of a three-dimensional Cartesian coordinate system; and a set of five horizontally polarized antenna elements arranged such that a center of each horizontally polarized antenna element is positioned along the Z-axis with the set of three vertically polarized antenna elements, wherein a first horizontally polarized antenna element of the set of five horizontally polarized antenna elements extends in a horizontal X-axis direction of the three-dimensional Cartesian coordinate system and is arranged concentrically a first vertically polarized antenna element the set of three vertically polarized antenna elements, forming a first pair of orthogonal antenna elements, a second horizontally polarized antenna element of the set of five horizontally polarized antenna elements extends in the horizontal X-axis direction and is arranged concentrically a second vertically polarized antenna element the set of three vertically polarized antenna elements, forming a second pair of orthogonal antenna elements, a third horizontally polarized antenna element of the set of five horizontally polarized antenna elements extends in the horizontal X-axis direction and is arranged concentrically a third vertically polarized antenna element the set of three vertically polarized antenna elements, forming a third pair of orthogonal antenna elements, a fourth horizontally polarized antenna element of the set of five horizontally polarized antenna elements extends in a horizontal Y-axis direction of the three-dimensional Cartesian coordinate system and is situated between the first pair and the second pair of orthogonal antenna elements, and a fifth horizontally polarized antenna element of the set of five horizontally polarized antenna elements extends in the horizontal Y-axis direction and is situated between the second pair and the third pair of orthogonal antenna elements.

2. The omnidirectional antenna module as claimed in claim 1, wherein the set of three vertically polarized antenna elements are arranged to exhibit a one-wavelength spacing between adjacent vertically polarized antenna elements.

3. The omnidirectional antenna module as claimed in claim 2, wherein the fourth and fifth horizontally polarized antenna elements are arranged to exhibit a one-half-wavelength spacing between adjacent pairs of orthogonal antenna elements.

4. The omnidirectional antenna module as claimed in claim 1, wherein the set of three vertically polarized antenna elements and the set of five horizontally polarized antenna elements comprise dipole antenna elements.

5. The omnidirectional antenna module as claimed in claim 1, wherein the set of three vertically polarized antenna elements and the set of five horizontally polarized antenna elements comprise slot antenna elements.

6. A method for configuring an omnidirectional antenna comprising:

arranging a set of three vertically polarized linear dipole antenna elements in a collinear configuration along a vertical Z-axis of a three-dimensional Cartesian coordinate system;

arranging a set of three horizontally polarized linear dipole antenna elements concentrically with the set of three vertically polarized linear dipole antenna elements, with a center of each horizontally polarized linear dipole antenna element positioned on the Z-axis, the set of three horizontally polarized linear dipole antenna elements oriented parallel to a X-axis horizontal direction of the three-dimensional Cartesian coordinate system;

positioning a fourth horizontally polarized linear dipole antenna element between a first horizontally polarized linear dipole antenna element and a second horizontally polarized linear dipole antenna element of the set of three horizontally polarized linear dipole antenna elements, the fourth horizontally polarized linear dipole antenna element having a center positioned on the Z-axis and oriented parallel to a Y-axis horizontal direction of the three-dimensional Cartesian coordinate system; and positioning a fifth horizontally polarized linear dipole antenna element between the second horizontally polarized linear dipole antenna element and a third horizontally polarized linear dipole antenna element of the set of three horizontally polarized linear dipole antenna elements, the fifth horizontally polarized linear dipole antenna element having a center positioned on the Z-axis and oriented parallel to the Y-axis horizontal direction.

7. The method as claimed in claim 6 wherein the set of three vertically polarized linear dipole antenna elements is arranged to include a one-wavelength spacing between adjacent linear dipole antenna elements, and the fourth and fifth horizontally polarized linear dipole antenna elements are positioned at a one-half-wavelength location between adjacent horizontally polarized linear dipole antenna elements.

8. The method as claimed in claim 6 further comprising the step of mounting the omnidirectional antenna module in a single radome of a small cell base station.

* * * * *